US005715605A

United States Patent [19]

Nadeau

[11] Patent Number: 5,715,605

[45] Date of Patent: Feb. 10, 1998

[54] PAPER ROLL SLABBING TOOL

[76] Inventor: Jacques Nadeau, 420 Blvd. Mgr. Pichette, Edmundston, New Brunswick, Canada, E3V 3Y7

[21] Appl. No.: 629,028

[22] Filed: Apr. 8, 1996

[51] Int. Cl.[6] ..... B26B 29/00

[52] U.S. Cl. ..... 30/293; 30/286; 30/294; 83/924

[58] Field of Search ..... 30/286, 287, 292, 30/293, 294, 314, 315, 320, 125; 83/924

[56] References Cited

U.S. PATENT DOCUMENTS

| | | | |
|---|---|---|---|
| 157,162 | 11/1874 | Duncan et al. | 30/280 X |
| 2,924,010 | 2/1960 | Umholtz | 30/293 |
| 2,966,742 | 1/1961 | Harian | 30/286 X |
| 3,363,314 | 1/1968 | O'Brien | 30/125 |
| 3,513,744 | 5/1970 | Hersberger | 83/520 |
| 3,872,591 | 3/1975 | Quenot | 30/125 X |
| 3,934,341 | 1/1976 | Carlson | 30/287 |
| 3,991,467 | 11/1976 | Yokoyama | 30/293 |
| 4,001,936 | 1/1977 | Matsushita | 30/287 |
| 4,031,616 | 6/1977 | Hines et al. | 30/293 X |
| 4,238,664 | 12/1980 | Anderson | 30/293 X |
| 4,286,384 | 9/1981 | Kotchy | 30/287 |
| 4,476,761 | 10/1984 | Bird | 83/614 |
| 4,506,575 | 3/1985 | McCay et al. | 83/368 |
| 4,527,750 | 7/1985 | Juntti | 83/614 X |
| 4,864,729 | 9/1989 | Funger | 30/293 X |
| 4,864,906 | 9/1989 | Hall | 83/886 |

FOREIGN PATENT DOCUMENTS

| | | |
|---|---|---|
| 784018 | 4/1968 | Canada . |

*Primary Examiner*—Eugenia Jones
*Attorney, Agent, or Firm*—Mario D. Theriault

[57] ABSTRACT

A hand tool for slabbing a roll of paper, comprising an elongated carriage frame having handle means affixed thereto. The hand tool also has casters mounted on each side of the carriage frame for movably supporting the frame along an upper segment of that roll. There is also provided a blade carrier attached to the elongated frame and a cutting blade mounted in that blade carrier. During use, the cutting blade extends beneath the elongated frame, with a cutting edge thereof facing towards a forward end of the frame. The elongated frame may also comprise a pivotally lockable blade guard enclosing the cutting blade when the hand tool is lifted off a work surface, for further enhancing a safe handling of the tool. In accordance to a further aspect of the present invention, there is provided a method for slabbing a roll of paper comprising the step of pushing a cutting blade through several plies of paper in a direction along the axis of the roll, while holding the blade at a lateral inclination relative to a path of cutting of that blade of between about 10° and about 30° measured from a radius of the roll.

20 Claims, 7 Drawing Sheets

PAPER ROLL SLABBING TOOL

FIELD OF THE INVENTION

The present invention relates to an implement for removing residual layers of paper wrapped around a paper mill roll core. More particularly, the present invention relates to a hand actuated carriage supporting and guiding a cutting blade along the surface of a paper roll, for slitting therefrom slabs of paper.

BACKGROUND OF THE INVENTION

The paper of a paper mill is usually wound on large mandrels spanning the full width of a paper machine. The large paper rolls thus formed are transferred onto an unwinding machine where smaller rolls are produced to a diameter and a width according to a customer's order.

It is a common occurrence in a paper mill that an entire such intermediate paper roll is not always rewound into a finished product. The paper produced during grade changeover for example, or the portion of a roll left over at the end of a run on the unwinding machine must be cut out of the large core, to permit reuse of the core and to permit recycling of the residual paper.

A conventional method for removing the layers of paper from a large paper roll core is to sequentially cut several plies at the time along the longitudinal upper segment of the roll. The severed plies unfold down in a flat pattern on top of one-another and can be then transported into a repulper. This process is generally referred to in the trade of paper making as slabbing a core.

Several types of machines have been developed in the past for slabbing a paper roll core. For example U.S. Pat. No. 4,506,575 issued on Mar. 26, 1985 to Johny A. McCay et al. discloses a core slabber for use in paper mills. The machine has a cantilevered shaft for supporting a roll of paper and a cutting device which successively cut through the layers of paper on the core, slabbing the paper and permitting it to fall off.

In another example, the U.S. Pat. No. 4,864,906 issued on Sep. 12, 1989 to Troy L. Hall describes a second type of core slabbing machine. This machine also has a cantilevered mandrel, and a freely rotatable circular blade moving horizontally back and forth to cut residual paper from a mill roll core.

In a further example, Canadian Patent no. 784,018 issued on Apr. 30, 1968 to Gilbert G. Bayley, illustrates an apparatus for cutting paper off of a paper roll. The apparatus comprises an arbour on which a partially used roll may be mounted, and comprising also a motor driven knife which moves axially in a direction parallel to the arbour, for cutting the paper off the roll core from one end to the other.

In modern paper mills, the winding mandrel of a paper machine can have a diameter as large as 20 inches and a length as long as 18 feet or more. Actually, these rolls having residual paper thereon can sometimes have an overall outside diameter of 36 inches or more, and weigh several tons. Therefore it is not always practical to support these large rolls in a cantilevered mode, or to lift them off the floor with an arbour through their core as suggested by the prior art apparatus. These heavy rolls are simply left of the floor, and the paper is cut off the cores by paper mill workers using each a craftsman's utility knife.

The slabbing of a core with an utility knife is a tedious process where workers tend to develop hand and wrist sprains. In order to lessen the fatigue of the task, paper mill workers sometimes modify their grip on the knife and push it along instead of pulling on it as it is recommended. This practice is known for breaking knife blades and for causing severe injuries to the forearm and elbow of the user from scratching against the portion of a broken blade protruding from the surface of the roll.

In spite of the inconveniences and hazards of slabbing a paper roll with an utility knife, it has been found that the type of blade used in those knives is ideal for slicing through several layers of paper on a paper roll. Therefore, and notwithstanding the injuries associated with this activity, this manual method of slabbing a paper roll is widely used in the paper making industry.

SUMMARY OF THE INVENTION

In the present invention, however, there is provided in a broad sense, a hand tool for slabbing a roll of paper, comprising an elongated carriage frame having a nominal length, width and depth, and handle means affixed thereto. The hand tool also has casters mounted on a right side and on a left side of the elongated frame for movably supporting the elongated frame along an upper segment of that roll.

There is also provided a blade carrier attached to the elongated frame and a cutting blade mounted in that blade carrier. During use, the cutting blade extends beneath the elongated frame and has a cutting edge facing towards a forward end of the elongated frame.

A first advantage of this aspect of the present invention is that a user thereof can slit a nominal layer of paper from the paper roll with ease for having a firm manual control of the cutting blade and for being able to move the elongated frame in a frictionless straight motion.

In accordance to another aspect of the present invention, the handle means is a first mushroom type handle projecting from an upper side and near a forward end of the elongated frame, and a second full-palm type handle projecting from an upper side and near a rear end of the elongated frame. Both handles are advantageously used for handling the hand tool of the present invention in a manner similar to the handling of a carpenter's plane. Both handles provide a firm grip on the tool while both hands of a user are held at a safe distance from the cutting edge of the blade.

In accordance to yet another aspect of the present invention, the elongated frame comprises a pivotally lockable blade guard. The blade guard encloses the cutting blade when the hand tool is lifted off a work surface for further enhancing a safe handling of this hand tool.

In accordance to a further aspect of the present invention, the blade carrier also comprises a blade holder having a removable lock plate for retaining the cutting blade in the blade holder, and a cam-pin for retaining the lock plate in a blade retaining position. Hence, in this further aspect of the present invention, blade changes are effected quickly without using additional tooling.

In accordance to yet a further aspect of the present invention, there is provided a method for slabbing a roll of paper comprising the step of pushing a cutting blade through several plies of paper in a direction along an axis of the roll of paper, while holding the blade at a lateral inclination relative to a path of cutting of that blade of between about 10° and about 30° measured from a radius of the roll.

Such an angle of cutting causes the blade to float at the set depth rather than being squeezed and pulled into a cut. This angle is also known to require a minimum pushing force on a cutting blade used during the slabbing of a roll of paper.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
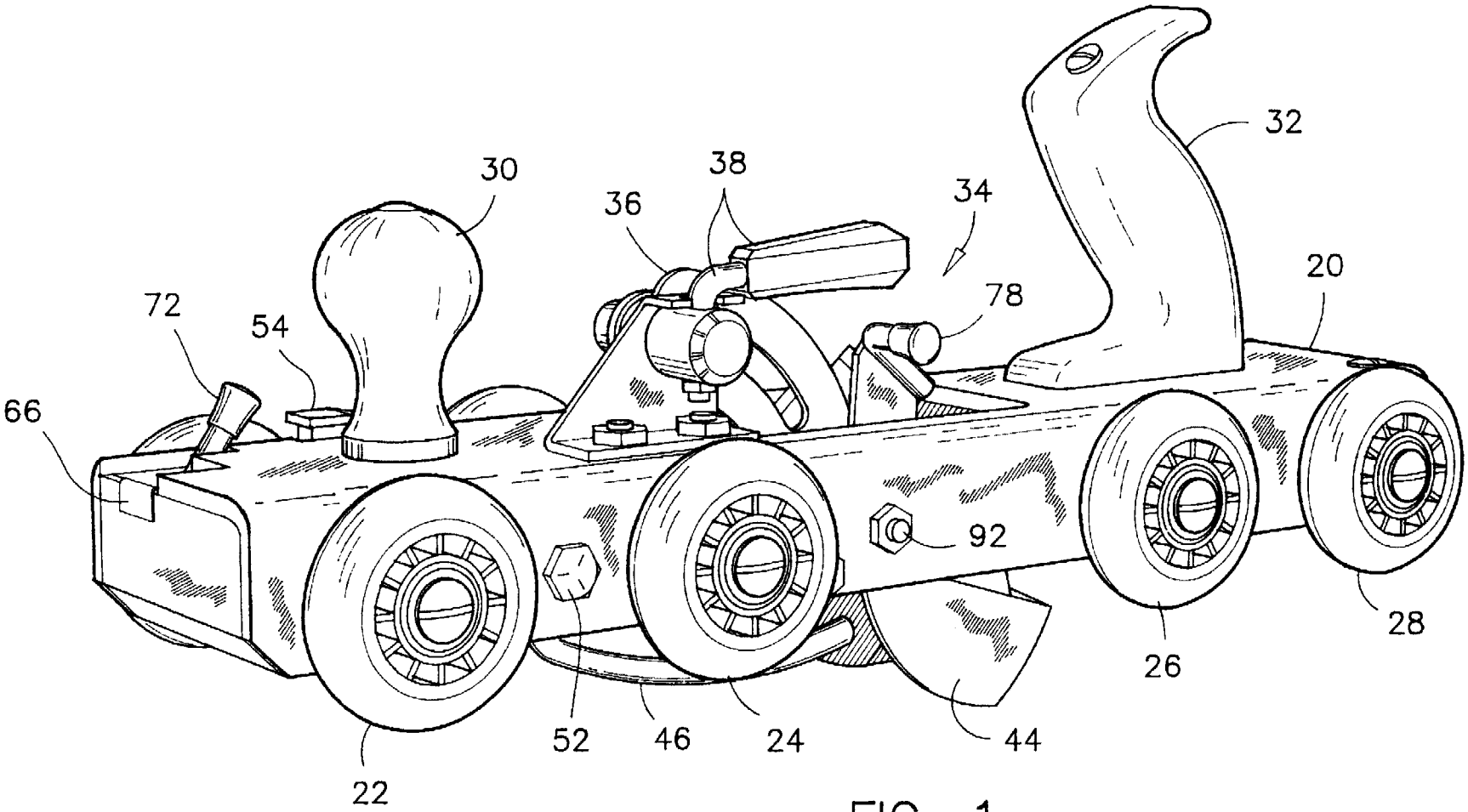
FIG. 1 is a perspective left side, front and top view of the paper roll slabbing tool of the preferred embodiment.
Figure 3:
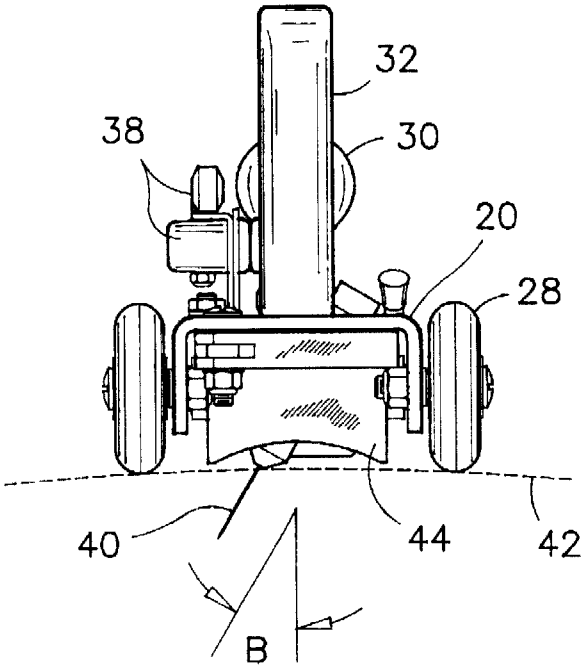
FIG. 3 is a rear view thereof.
Figure 2:
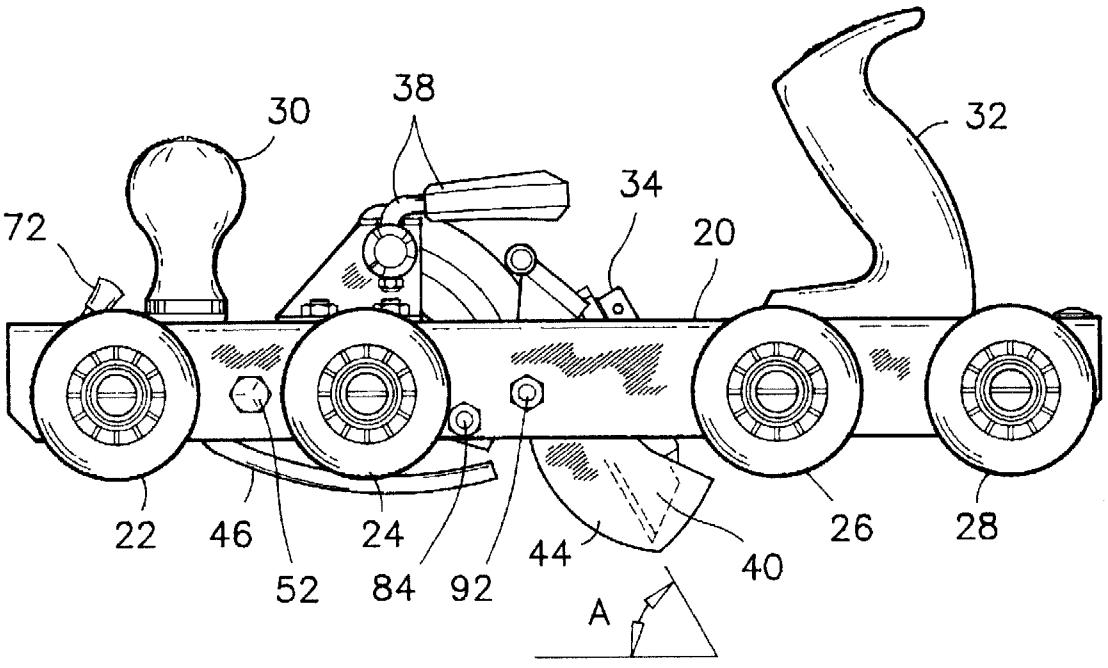
FIG. 2 is a left side view thereof.

Referring to FIGS. 1, 2 and 3, there is illustrated a paper roll slabbing tool of the preferred embodiment. The paper roll slabbing tool comprises an elongated carriage frame 20 and four pairs of casters 22,24,26,28 attached thereto.

The carriage frame 20 also has a front handle 30, preferably the shape of a mushroom type handle, and a rear handle 32, preferably the shape of a full-palm type handle. Both handles being similar to the handles of a wood plane, for manually moving the slabbing tool along the surface of a roll in a manner similar to the movement of a carpenter's plane. In the same respect, a preferred overall length of the elongated carriage frame 20 is about 15¼", a preferred center-line distance between casters of each pair of casters is about 4⅜", and a preferred material of construction is aluminum such that the slabbing tool is manipulated easily.

The principal advantages of casters 22,24,26,28 are firstly that the elongated carriage frame 20 is easily pushed along a surface of a roll to be slabbed. Secondly, and because in use the casters are set astride the curvature of the roll, the elongated carriage frame 20 remains aligned with the longitudinal axis of that roll.

The slabbing tool also has a blade carrier 34 which is only partly seen on the Figures referred to, but which will be explained in greater details when making reference particularly to FIGS. 5, 11 and 12.

The blade carrier 34 has a slotted adjuster plate 36 extending vertically therefrom and mating into a cam-lock assembly 38. The depth of the cutting blade 40 is thereby adjustable in relation to the surface of a roll 42 as seen on FIG. 3.

When the slabbing tool is lifted off a roll surface, a blade guard 44 mounted inside the carriage frame 20 pivots downwardly to enclose the cutting blade 40, and to prevent a user of the tool from inadvertently contacting the cutting edge of the blade 40.

The blade guard 44 normally remains locked in a down position by a locking mechanism. The locking mechanism as will be explained later may be released to allow the blade guard 44 to retract, by setting the tool on a roll surface causing a trailing rod or actuator member 46 to raise and to disengage the locking mechanism.

A preferred inclination of the cutting edge of the blade 40 in the direction of cutting is between about 40° and about 60° from the surface of the roll, as illustrated by label 'A' on FIG. 2. Similarly, a lateral inclination relative to a direction of travel, as indicated by label 'B' on FIG. 3, is between about 0° and 30° from a radial line of the roll, and preferably between about 10° and about 30° from such radius.

While the angle 'A' is known to be a typical orientation for handling a craftsman's utility knife, the angle 'B' has been found to affect the required force on the tool and the associated stresses on the blade 40. Although a small angle 'B' is preferred for certain types of paper and certain sizes of rolls, a large angle 'B' has been found advantageous when using the tool on large rolls.

It has been found that in certain circumstances when the blade is set at a radial orientation, the blade tends to dig in and be squeezed into the cut, whereas when the blade 40 it is set at an inclination as shown on FIG. 3, the blade tends to float at the set depth.

In other circumstances, however, a radial orientation of the blade has given the best operation. Therefore it is recommended to test the proposed application before selecting a best angle 'B' for the cutting blade 40. Alternatively, the blade carrier 34 may be fitted with a lateral angular blade adjuster which is not shown here for being known in the field of manual implements and especially in the field of woodworking tools.

Figure 4:
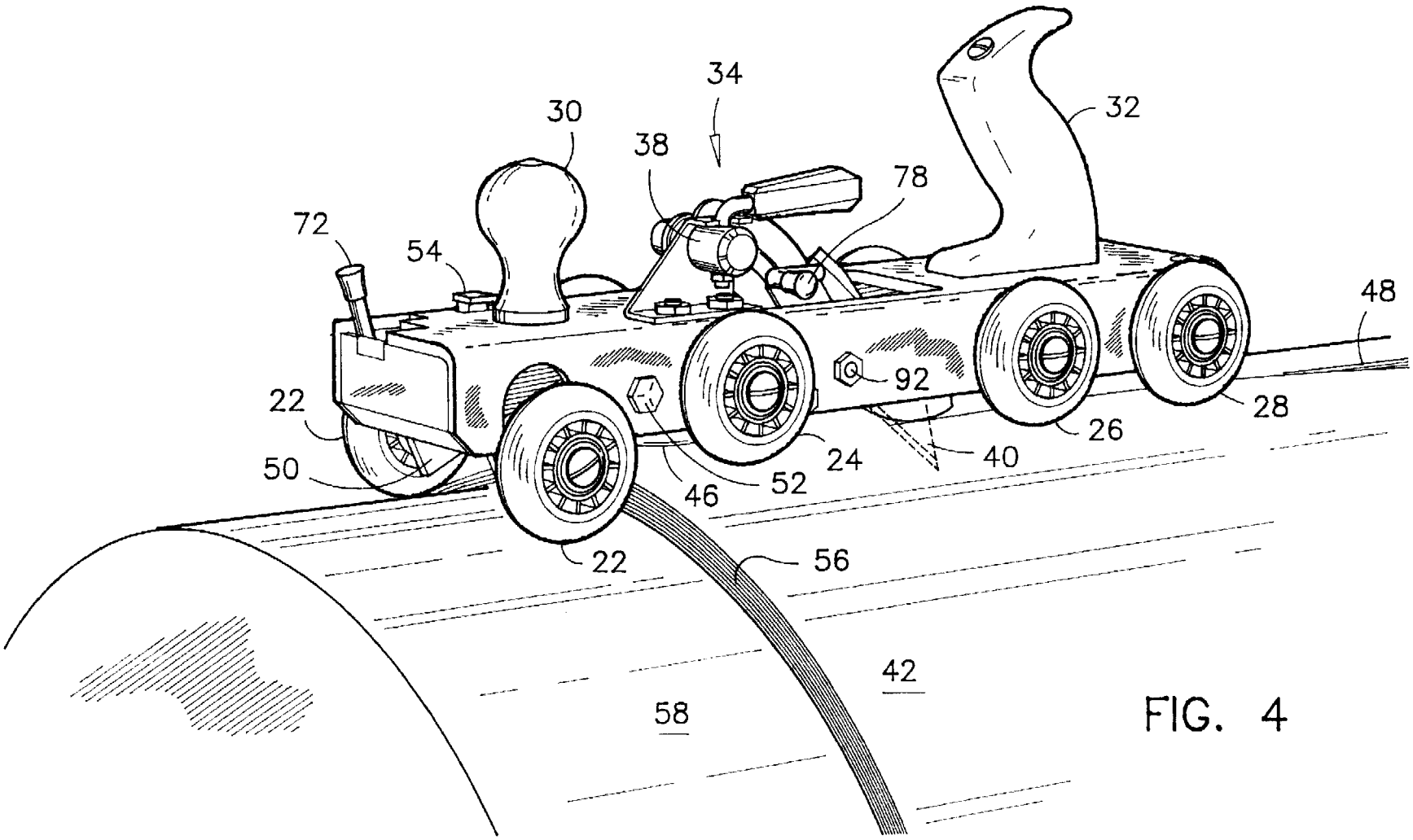
FIG. 4 is a perspective left side, from and top view of the paper roll slabbing tool of the preferred embodiment positioned in a working mode on a paper roll.

Referring now to FIG. 4, there is illustrated the paper roll slabbing tool of the preferred embodiment in an operating mode on a paper roll 42, and about to reach the end of a cut 48. The forward pair of casters 22 of the slabbing tool is mounted on a sub-frame 50 which is pivotally movable about an axis through bolt 52 on the carriage frame 20. The movement of the sub-frame 50 is controlled in a downward direction by a first lever 72, and in an upward direction by a ratchet type mechanism comprising a thumb lever 54.

In use, the paper roll slabbing tool is pushed in successive passes along the upper segment of a paper roll, slicing a few layers therefrom at every pass. When the last plies 56 on a core 58 are being slit off, as illustrated in FIG. 4, the first lever 72 may be shifted forwardly, allowing the sub-frame 50 to pivot downwardly. This causes the front casters 22 to lower on the core 58 while continuing to support the tool in a path parallel to the surface of the roll, for preventing the blade 40 from digging into the core 58 at the end of this last cut.

During the lowering of the front casters 22, the second forward pair of casters 24 continues to support, in cooperation with the rearmost casters 26,28, the slabbing tool in a path parallel to the surface of the roll.

Likewise when the lowering feature of the front casters 22 is not selected, during the slabbing of the outer layers of a roll of paper for example, the two pairs of rearmost casters 26,28 maintain the slabbing tool in a parallel path with the surface of the roll, even when both pairs of foremost casters 22,24 project beyond any supporting surface at the very end of a cut.

Figure 6:
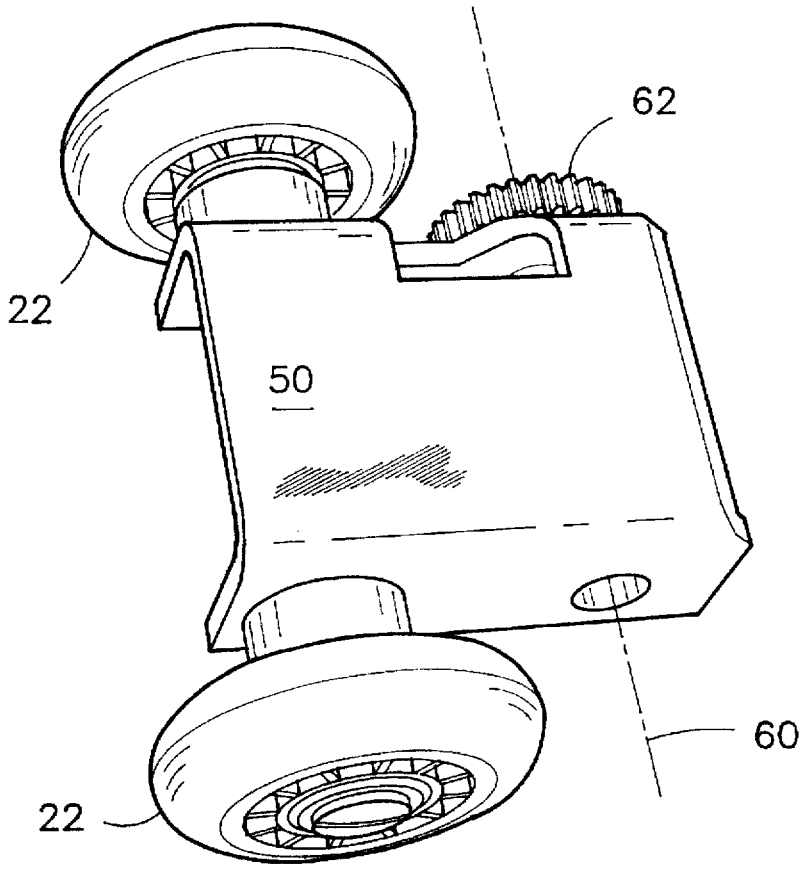
FIG. 6 is a perspective left side and top view of a sub-frame supporting the forward wheels of the paper roll slabbing tool of the preferred embodiment.
Figure 7:
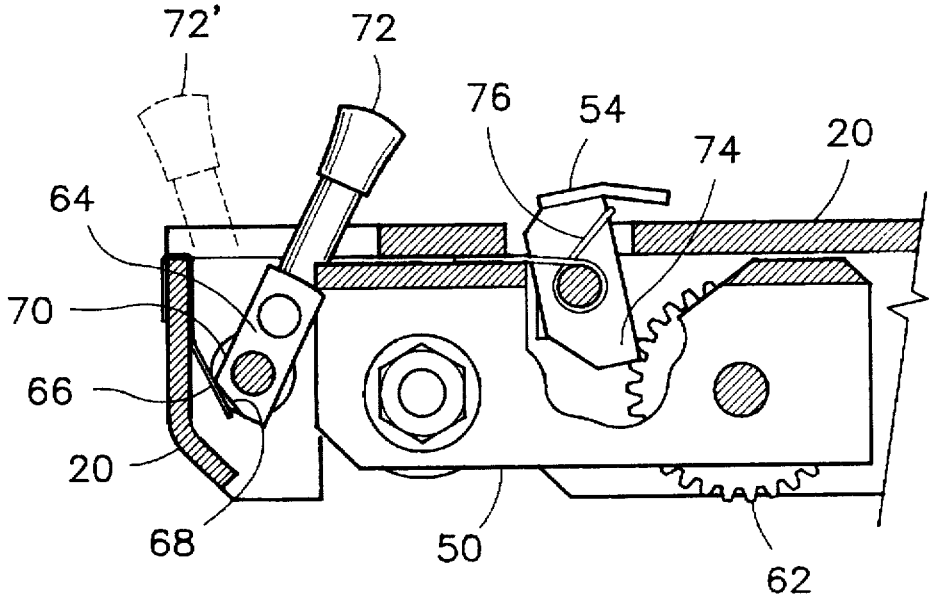
FIG. 7 is a cross-section view of the preferred embodiment along line 7—7 of FIG. 5.
Figure 8:
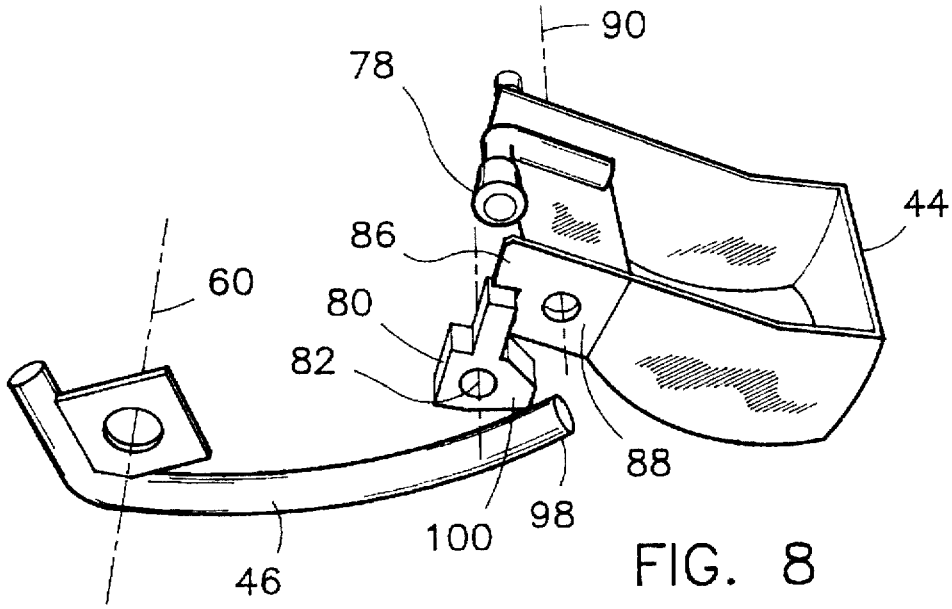
FIG. 8 is a perspective side view of the blade guard locking mechanism of the paper slabbing tool of the preferred embodiment.
Figure 9:
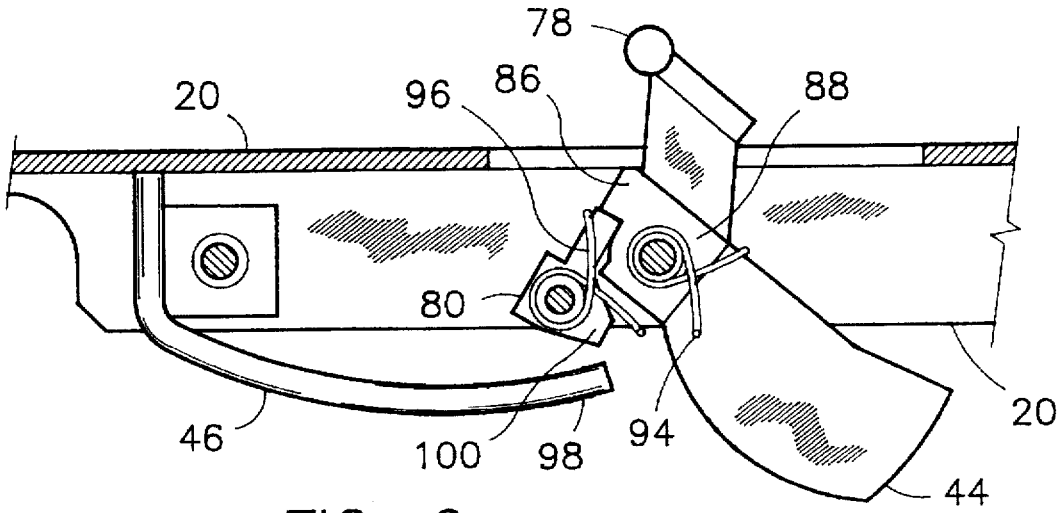
FIG. 9 is a side view of the blade guard locking mechanism thereof, with the blade guard in the locked down position.
Figure 10:
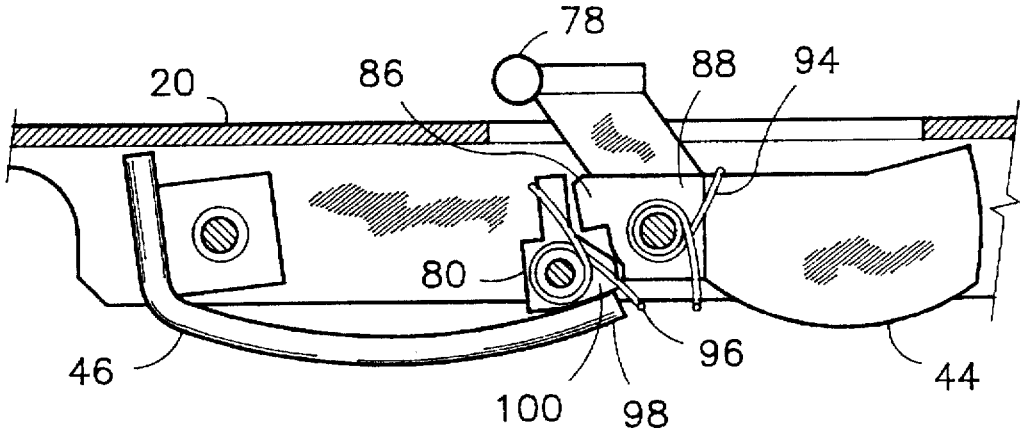
FIG. 10 is also a side view of the blade guard locking mechanism thereof, illustrating the blade guard in the unlocked mode.

In order to explain the movement of the front casters 22 in greater details, reference may be made to FIGS. 4, 6 and 7. The sub-frame 50 is pivotally mounted about an axis 60 along bolts 52 on the carriage frame 20. During normal operation of the slabbing tool, the sub-frame 50 is held in an upper position by a first latch block 64 of the first lever 72 as it can be seen on FIG. 7.

The movement of first lever 72 is somewhat restricted by a first leaf spring 66 acting against a first flat region 68, or against a second flat region 70 of the first latch block 64. Such an interference of the first leaf spring 66 with the first latch block 64 retains the first lever 72 in a first locking position or in a second disengaged position 72' as shown in dotted lines on FIG. 7.

A downward motion of the sub-frame 50 is controlled by a ratchet type mechanism comprising a gear 62 which is rigidly mounted on a side of the sub-frame 50 in alignment with axis 60. When the sub-frame 50 is allowed to lower as shown on FIG. 4, the gear 62 interferes with a sharp edge 74 on the thumb lever 54 to prevent the sub-frame 50 from rising back.

In order to efficiently control the movement of the sub-frame 50 in a downward direction, a first torsion spring 76 urges the thumb lever 54 against the gear 62 to maintain an engagement therebetween at all times.

The sub-frame 50 may be returned to an uppermost position by applying a rearward pressure on the thumb lever 54, causing the sharp edge 74 to disengaged from the gear 62. Concurrently, the shifting of the first lever 72 in a rearward inclination retains the sub-frame 50 in this uppermost position.

Referring now to FIGS. 5, 8, 9 and 10, axis 60 of bolts 52 also supports the trailing rod 46 of the blade guard locking mechanism. This mechanism comprises essentially the trailing rod 46, a second latch block 80 pivotally mounted about an axis 82 of bolt 84 and a tab 86 adjacent a mounting member 88 of the blade guard 44. The blade guard 44 is also pivotally movable about an axis 90 of bolts 92 as can be seen on FIG. 5.

In operation, the blade guard 44 is urged downwardly by a second torsion spring 94 attached at a fixed end to the carriage frame 20. The second latch block 80 is also urged against the mounting portion 88 of the blade guard 44 by a third torsion spring 96 also having a fixed end attached to the carriage frame 20.

When the slabbing tool is lifted up from a working surface, the blade guard 44 automatically rotates downwardly to enclose the cutting blade 40. Also during this motion, the second locking block 80 automatically rotates rearward to interfere with tab 86 and to lock the blade guard 44 in a down position.

Alternately, when the slabbing tool is placed against a flat surface where both the trailing rod 46 and the blade guard 44 are forced upwardly, the loose end 98 of the trailing rod 46 pushes against a portion 100 of the second locking block 80, causing this second locking block 80 to rotate forwardly and to disengage itself from the tab 86. This movement causes the blade guard 44 to raise and to expose the cutting blade 40.

In order to assist an optional manual raising or lowering of the blade guard 44, a second lever 78 has been provided on an upper edge of the mounting member 88.

Figure 5:
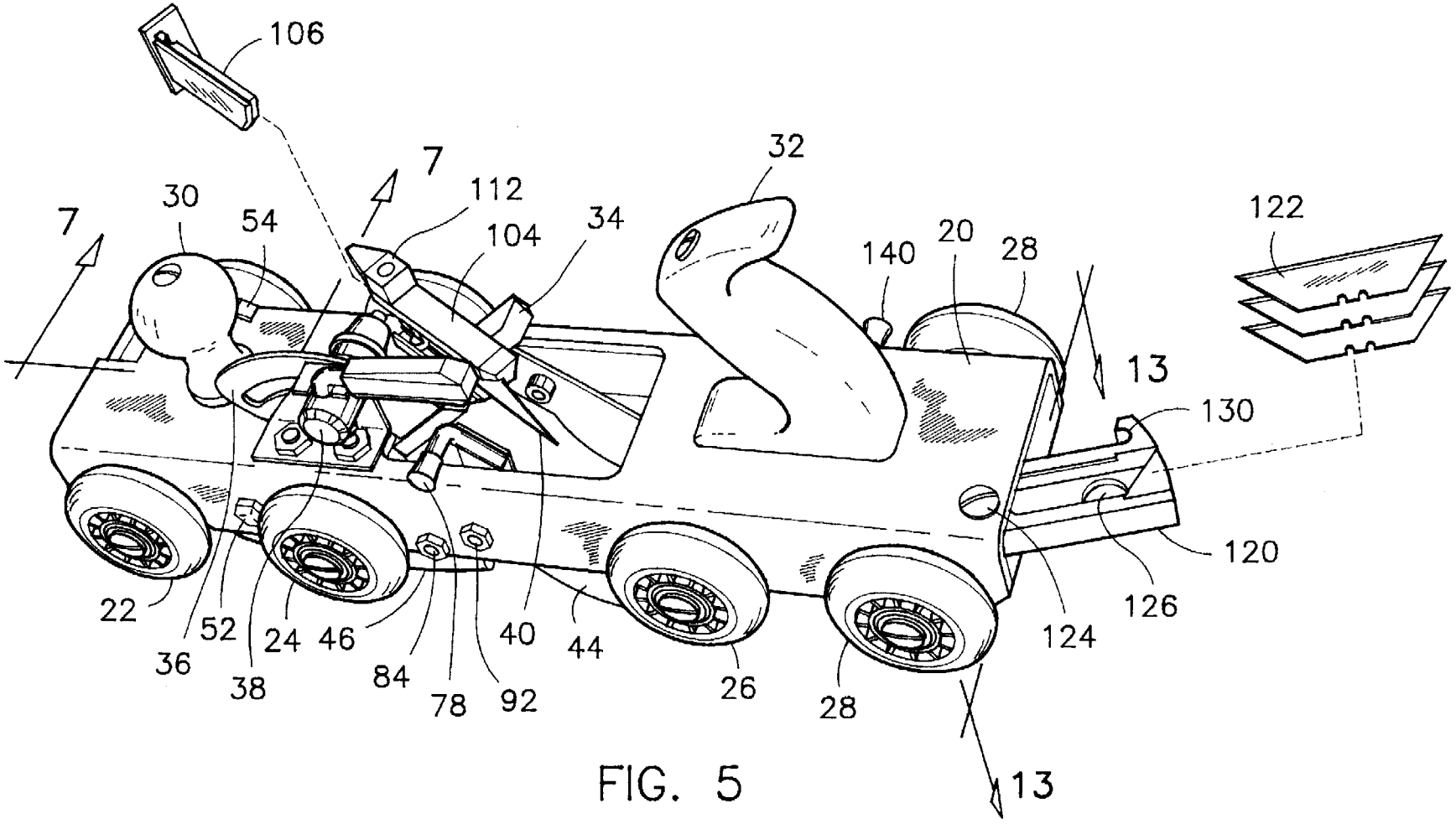
FIG. 5 is a perspective left side, top and rear view thereof showing an opened blade storage compartment and a disassembled blade lock plate.
Figure 11:
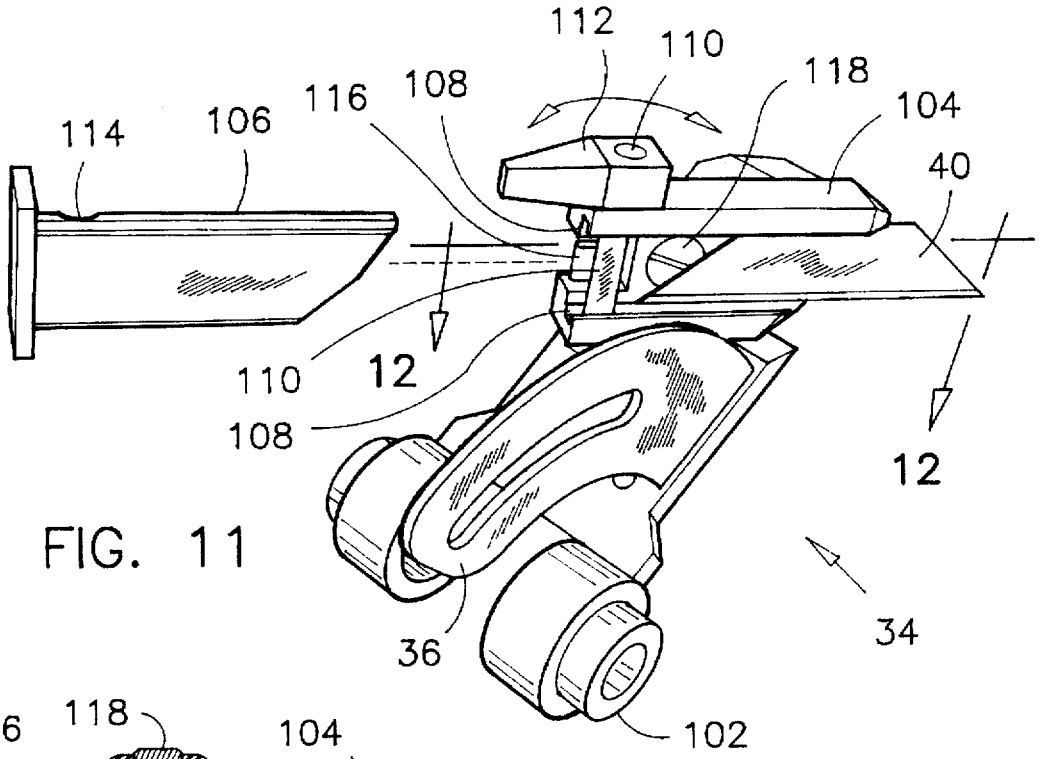
FIG. 11 is a perspective top, left side and front view of the blade carrier of the paper roll slabbing tool of the preferred embodiment.
Figure 12:
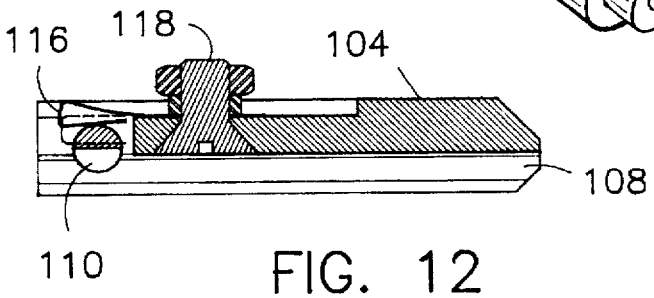
FIG. 12 is a cross section view of the blade holder of the preferred embodiment along line 12—12 of FIG. 11.

Referring now specifically to FIGS. 5, 11 and 12, the blade carrier 34 of the paper roll slabbing tool of the preferred embodiment is pivotally mounted transversally inside the elongated carriage frame 20 about the axis of rotation of casters 24, by means of bolts through two bosses 102.

The blade carrier 34 is pivotally adjustable about its axis of mounting by means of a vertical slotted adjuster plate 36 mating with the cam lock assembly 38 as previously explained.

The blade carrier 34 comprises a blade holder 104 supporting an utility knife blade 40. The cutting blade 40 is held inside the blade holder 104 by a rounded projection interfering into a rounded notch on the upper edge of the blade 40. Such engagement is not illustrated here for being common to all utility knives using similar cutting blades.

The cutting blade 40 is also held inside the blade holder 104 by means of a lock plate 106 slidable into a pair of opposite grooves 108 in the blade holder 104. The lock plate 106 is held inside the blade holder 104 against the cutting blade 40 by a cam pin 110 connected to a turn-knob 112.

The cam pin 110 has a machined portion having a half circle cross-section as better seen on FIG. 12, whereby when the turn-knob 112 is pointing towards the cutting blade 40, the rounded portion of the pin 110 interferes with a rounded groove 114 on the lock plate 106 to retain the lock plate 106 inside the blade holder 104.

A further feature of this quick-change blade holder 104 is that the rotational movement of the cam pin 110 is controlled by a second leaf spring 116 held against the blade holder 104 by a countersunk head bolt 118 through the body of the blade holder 104, as shown on FIG. 12. When the turn-knob 112 is turned in a locked position, the second leaf spring 116 pushes against the flat portion of the lock pin 110 for preventing the pin from rotating freely.

The replacement of a cutting blade 40 on this preferred embodiment is done quickly without tooling. The replacement of a blade simply consists of slackening the cam-lock assembly 38, raising the blade carrier 34 as seen on FIGS. 5 and 11, turning the turn-knob 112 half a turn in a direction pointing away from the cutting blade 40, sliding the lock plate 106 out of grooves 108, and replacing the cutting blade 40. Then the blade is secured in place by reinstalling the lock plate 106 into the blade holder 104, and the blade carrier 34 is repositioned in an operating position.

Figure 13:
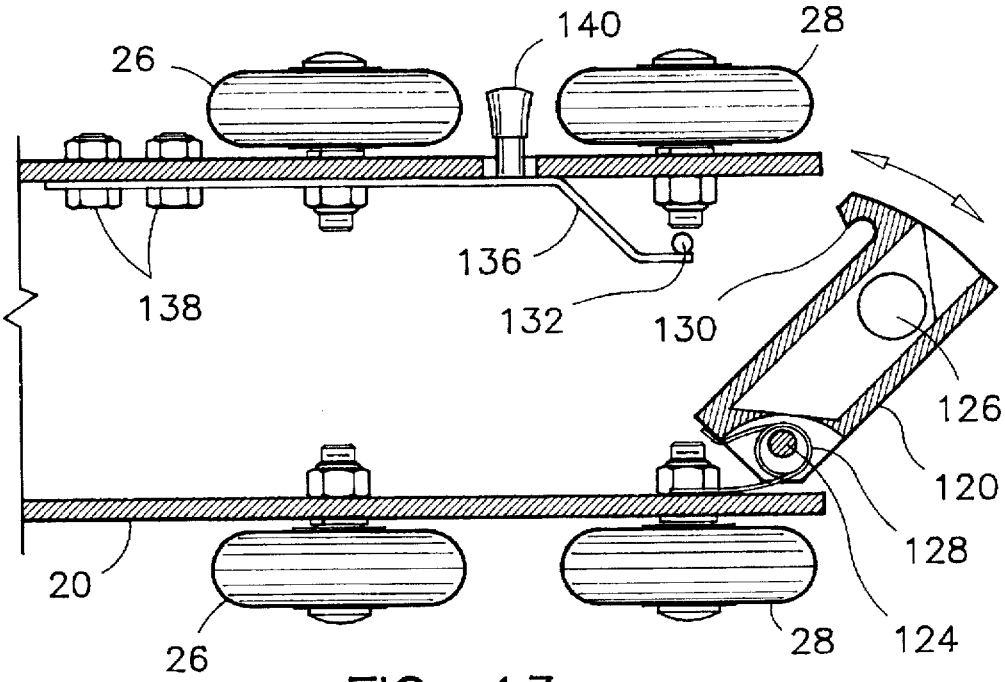
FIG. 13 is a cross section view of a rear portion thereof along line 13—13 of FIG. 5.

The slabbing tool of the preferred embodiment may also optionally comprise a blade storage compartment 120 for storing a number of spare cutting blades 122. This compartment is illustrated on FIGS. 5 and 13. The blade storage compartment is horizontally movable about a mounting bolt 124 through an upper surface of the carriage frame 20.

The blade storage compartment has a cavity for retaining a number of spare cutting blades 122. The bottom portion of this cavity has a hole 126 the size of which can accommodate the tip of a finger, whereby a user can push the spare blades upwardly for removing a blade from the compartment.

The compartment 120 is urged rearward by a fourth torsion spring 128. The blade storage compartment 120 also has a hook-shaped formation 130 on an inner side thereof. When the blade storage compartment 120 is in the closed position, the hook-shaped formation 130 interferes with a latching boss 132 on the end of a fifth leaf spring 136. The fifth leaf spring 136 is held to the carriage frame 20 by bolts 138 as shown of FIG. 13.

The leaf spring 136 also comprises a push-knob 140 protruding through the side of the carriage frame 20. A pressure from a user on the push-knob 140 deflects the spring 136 and disengages the boss 130 from the hook-shaped formation 130 to let the compartment 120 swing in an opened position.

The paper roll slabbing tool of the preferred embodiment as described and illustrated herein is a safe implement for slabbing a roll of paper manually. The tool provides a good grip for pushing a cutting blade through the surface of a roll, and its wheeled carriage allows a self-guided frictionless motion, reducing thereby the overall fatigue associated with roll slabbing operations.

The slabbing tool of the preferred embodiment reduces the potentialities of injuries from a broken blade protruding from a roll surface, by keeping both hands of a user away from the cutting blade and from the roll surface. Moreover the quick blade change feature, and other attributes described in the foregoing are advantageous for meeting the manpower efficiency requirements of modern days paper mills.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, operational features or the like. Therefore the above description and accompanying illustrations should not be construed as limiting the scope of the invention which is defined by the appended claims.

I claim:

1. A hand tool for slabbing a roll of paper, comprising:

an elongated hollow frame having a nominal length, width and depth, upper surface and side and end walls, and handle means affixed thereto;

a plurality of casters mounted on said elongated frame for movably supporting said elongated frame on a work surface;

a blade carrier connected to said elongated frame;

a cutting blade mounted in said blade carrier and extending beneath said elongated frame;

a blade guard movably connected to said elongated frame for selectively guarding said cutting blade, said blade guard being movable from a first position adjacent said cutting blade and extending below a projection of said cutting blade beneath said elongated frame, to a second position above said projection of said cutting blade beneath said elongated frame;

a blade guard locking mechanism movably connected to said elongated frame; said blade guard locking mechanism having an actuator member connected thereto; said actuator member being movable from a low position below a lower segment of at least one of said casters to an up position above said lower segment of said at least one of said casters;

said blade guard locking mechanism being connectable to said blade guard for preventing a movement of said blade guard from said first position, when said actuator member is in said low position; and said blade guard locking mechanism being releasable from said blade guard for releasing said blade guard and allowing a displacement of said blade guard to said second position, when said actuator member is in said up position;

whereby said blade guard is releasable from said first position when said actuator member is forced again said work surface.

2. A hand tool as claimed in claim 1 wherein said blade guard is urged toward said first position by spring means affixed to said elongated frame.

3. A hand tool as claimed in claim 1 wherein said handle means includes a first handle projecting from said upper surface near a forward end of said elongated frame, and a second handle projecting from said upper surface near a rear end of said elongated frame.

4. A hand tool as claimed in claim 1 wherein said cutting blade has a cutting edge set at a longitudinal inclination of between about 40° and about 60° with a plane of movement of said elongated frame along said work surface.

5. A hand tool as claimed in claim 4 wherein said cutting blade is set at a lateral inclination of between about 0° and about 30° with a line normal to said plane of movement.

6. A hand tool as claimed in claim 1 wherein said plurality of casters comprises at least two pairs of casters mounted near a front end of said elongated frame and at least one pair of casters mounted near a rear end of said elongated frame.

7. A hand tool as claimed in claim 6 wherein a foremost pair of said two pairs of casters is mounted on a sub-frame, and said sub-frame is pivotally connected to said elongated frame and is movable in up and down directions relative to a plane of movement of said elongated frame along said work surface.

8. A hand tool as claimed in claim 7 further comprising a bolt connected to said sub-frame and to said elongated frame about which said sub-frame is pivoted and a lever for selectively preventing a movement of said sub-frame in said up direction.

9. A hand tool as claimed in claim 1 wherein said blade carrier is movable relative to said elongated frame and comprises adjustment means for adjusting said cutting blade towards and away from said work surface.

10. A hand tool as claimed in claim 9 wherein said adjustment means comprises bolt means mounted on said elongated frame and a slotted plate having a slot therein mounted on said blade carrier; said blade carrier being movable relative to said bolt means a distance equivalent to at least a length of said slot; said bolt means being securely engageable in said slot in said slotted plate for positioning said blade carrier relative to said work surface.

11. A hand tool as claimed in claim 9 wherein said blade carrier also comprises a blade holder having a removable lock plate for retaining said cutting blade in said blade holder, and a cam-pin for retaining said lock plate in a cutting blade retaining position inside said blade holder.

12. A hand tool as claimed in claim 11 wherein said cam-pin has a flat region along the longitudinal axis thereof, and said blade holder has a leaf spring attached thereto acting on said flat region for controlling a rotation of said cam-pin about said longitudinal axis.

13. A hand tool as claimed in claim 1 wherein said elongated frame comprises a spare blade storage compartment mounted on a rear portion thereof.

14. A hand tool as claimed in claim 13 wherein said compartment is movable between open and closed positions and said elongated frame has latch means mounted therein protruding through one of said side walls and extending in a path of said compartment when said compartment is moved from said open position to said closed position, whereby said compartment is lockable in said closed position by said latch means.

15. A hand tool as claimed in claim 13 wherein said compartment has a cavity for retaining a number of spare cutting blades and a bottom portion of said cavity has a hole therethrough for allowing a dexterous removal of said spare cutting blades from said cavity.

16. A hand tool as claimed in claim 1 wherein said cutting blade is an utility knife blade.

17. A paper roll slabbing implement for manually slitting through several plies of paper on a paper mill roll core, comprising:

an elongated frame having a nominal length, width, depth and a normal longitudinal orientation;

a first handle projecting upwardly from a front portion of said elongated frame and a second handle projecting upwardly from a rear portion of said elongated frame;

a plurality of casters mounted on a right side and on a left side of said elongated frame for movably supporting said elongated frame in a working plane along a roll surface;

a blade carrier mounted in said elongated frame;

a cutting blade mounted in said blade carrier and extending beneath said elongated frame, said cutting blade having a cutting edge facing towards a forward end of said elongated frame;

said cutting edge being longitudinally inclined at an angle of between about 40° and about 60° with said working plane, and said cutting blade being laterally inclined at an angle of between about 0° and about 30° with a line normal to said working plane;

said blade carrier also comprising a blade holder having a removable lock plate for retaining said cutting blade therein, and a cam pin for retaining said lock plate in a blade locking position inside said blade holder;

said elongated frame further comprising a spare blade storage compartment mounted on a rear portion thereof;

a blade guard movably connected to said elongated frame and being movable from an up position exposing said cutting blade to a low position enclosing said cutting blade, for selectively enclosing said cutting blade when said casters are raised from said working plane;

whereby a use of the implement is efficient and safe.

18. A paper roll slabbing implement as claimed in claim 17 wherein said blade guard is urged toward said low position by spring means affixed to said elongated frame.

19. A paper roll slabbing implement as claimed in claim 17 wherein said elongated frame comprises a locking mechanism mounted therein for selectively locking said blade guard in said low position.

20. A paper roll slabbing implement as claimed in claim 17 wherein said plurality of casters comprises at least one foremost pair of casters closely spaced from a front end of said elongated frame, and two pairs of casters closely spaced from a rear end of said elongated frame for maintaining said elongated frame in said longitudinal orientation when said two pairs of casters closely spaced from said rear end are in contact with said roll surface and when said at least one foremost pair of casters project beyond said roll surface.

* * * * *